US007794308B2

(12) United States Patent
Wuensch et al.

(10) Patent No.: US 7,794,308 B2
(45) Date of Patent: Sep. 14, 2010

(54) HAND-HELD POWER TOOL

(75) Inventors: Steffen Wuensch, Holzgerlingen (DE); Alfred Frech, Leinfelden-Echterdingen (DE); Wolfgang Hirschburger, East Stowmarket (GB); Steffen Tiede, Herrenberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/910,800

(22) PCT Filed: Nov. 14, 2006

(86) PCT No.: PCT/EP2006/068447

§ 371 (c)(1),
(2), (4) Date: Oct. 5, 2007

(87) PCT Pub. No.: WO2007/073981

PCT Pub. Date: Jul. 5, 2007

(65) Prior Publication Data

US 2008/0153401 A1 Jun. 26, 2008

(30) Foreign Application Priority Data

Dec. 23, 2005 (DE) ..... 10 2005 061 870

(51) Int. Cl.
*B24B 23/00* (2006.01)

(52) U.S. Cl. ..... 451/344; 451/357; 451/359; 173/162.2

(58) Field of Classification Search ..... 451/340, 451/344, 356, 357, 359; 173/162.2
See application file for complete search history.

(56) References Cited

U.S. PATENT DOCUMENTS 4,266,376 A * 5/1981 Overy ..... 451/294
4,879,847 A * 11/1989 Butzen et al. ..... 451/344
4,905,772 A * 3/1990 Honsa et al. ..... 173/162.1

FOREIGN PATENT DOCUMENTS

DE 42 11 316 10/1993
DE 102 44 793 4/2004
EP 0 849 492 6/1998

* cited by examiner

*Primary Examiner*—Eileen P. Morgan
(74) *Attorney, Agent, or Firm*—Michael J. Striker

(57) ABSTRACT

The invention relates to a hand machine tool comprising a first housing shell (12, 150, 162), a second housing shell (16, 156, 168) different from the first housing shell (12, 150, 162) and being connected to the first housing shell (12, 150, 162) via a damping element (58, 60, 122, 132, 158, 170, 172), and a handle section (14, 152, 164) arranged on one of the housing shells (12, 150, 162). The invention is characterized in that the first housing shell (12, 150, 15 162) at least partially encloses the second housing shell (16, 156, 168).

31 Claims, 8 Drawing Sheets

HAND-HELD POWER TOOL

RELATED ART

Figure 1:
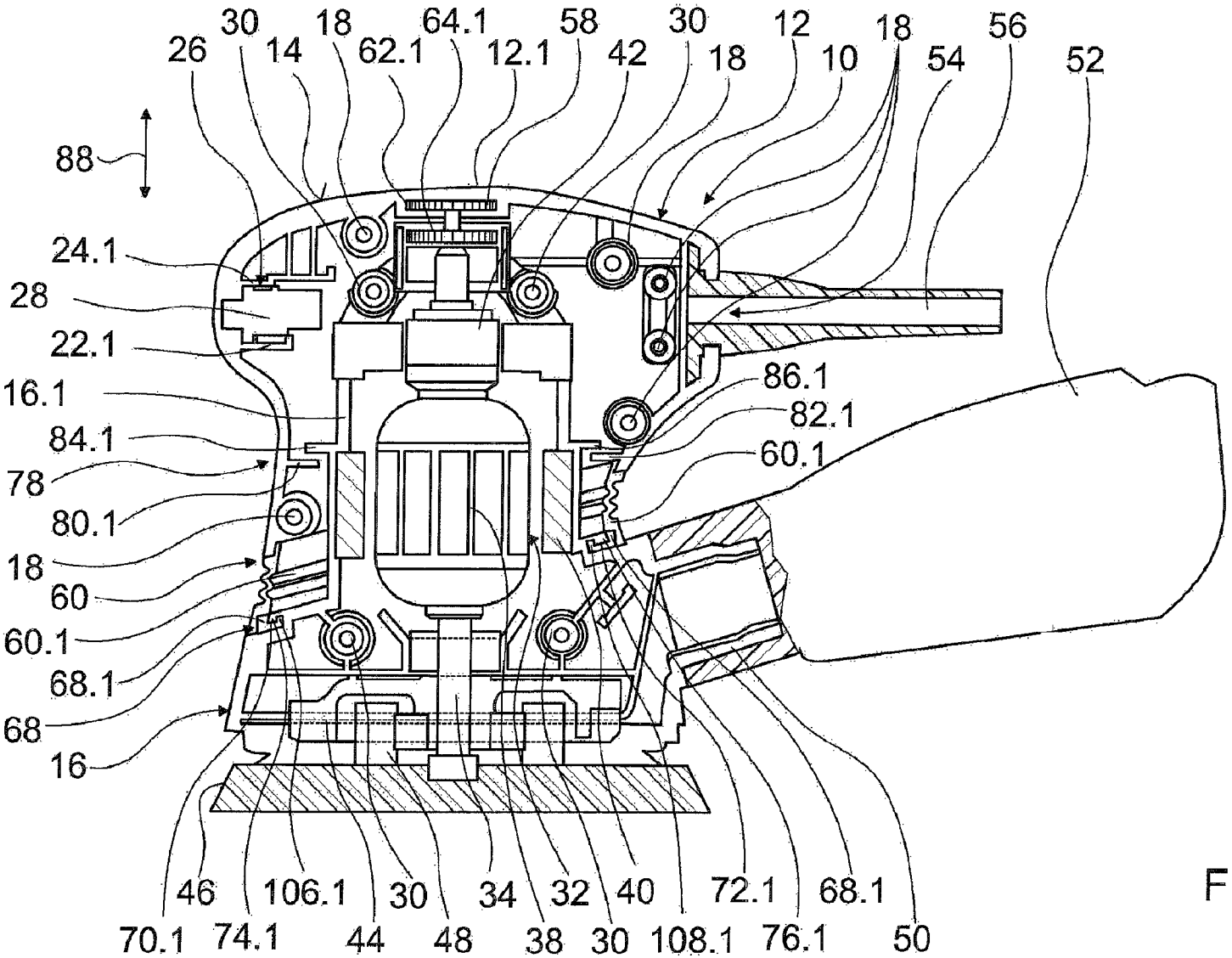

The present invention is directed to a hand-held power tool according to the definition of the species in Claim 1.

Publication DE 102 44 793 A1 makes known a hand-held power tool with a housing that includes a first housing shell for placement of a hand during operation, and a second housing shell. The housing shells are held together by a vibration-damping element.

ADVANTAGES OF THE INVENTION

The present invention is directed to a hand-held power tool with a first housing shell, a second housing shell that differs from the first housing shell—the second housing shell being connected with the first housing shell via damping means—and a hand placement region located on one of the housing shells.

It is provided that the first housing shell at least partially encloses the second housing shell. As a result, a large region of the hand-held power tool may be used as a vibration-damped hand placement region, which allows the user to hold the hand-held power tool in a comfortable, minimally disturbing manner. Internal parts of the hand-held power tool, such as motor, fan, transmission, tool fitting, tool, etc., which cause vibrations during operation, are preferably installed in the second housing shell. This allows the hand-held power tool to be held comfortably via the first housing shell in the region of these internal parts, thereby also making it possible for the operator to guide the hand-held power tool in a safe, reliable manner.

It is also provided that the first housing shell is connected with the second housing shell in a form-fit manner via the damping means. This results in effective damping, and additional elements for stabilizing the second housing shell on the first housing shell may be advantageously eliminated. Advantageously, the damping means are designed as compounded Thermoplast, which is composed of Thermoplast mixed with additional materials. For example, the damping means are designed as TPE (thermoplastic elastomer).

In a further embodiment of the present invention it is provided that the damping means—when in the installed state—enclose the second housing shell at least to a large extent, thereby making it possible to attain largely homogeneous vibration damping around the circumference of the hand-held power tool.

It is furthermore provided that the damping means are designed as a housing section that includes a housing outer surface. The need for material and space may be reduced as a result. The damping function of the damping means is perceivable by an operator.

When the hand-held power tool includes holding means for establishing a form-fit connection with at least one of the housing shells—the holding means being integrally joined with the damping means—transmission of vibrations between the two housing shells may be counteracted in a particularly effective manner.

In this context, simple assembly may also be attained when the holding element includes a fastening element, which is provided for establishing a snap-in connection with at least one of the housing shells.

Advantageously, the hand-held power tool includes securing means, which are provided to limit a relative motion of the first and second housing shell during operation. As a result, highly reliable operation of the hand-held power tool is attained. When the damping means fail, e.g., when they are overloaded and vibrations of the housing shells relative to each other occur, the amplitude of these vibrations may be limited. In particular, the securing means prevent the housing shells from becoming separated from each other when loads are very high. The securing means are preferably designed as a stop element, which, when strong vibrations occur, may advantageously transmit acoustic warning signals and thereby warn an operator about possible damage.

In a further embodiment of the present invention, it is provided that the damping means—in the installed state—bear against one of the housing shells with preload. As a result, the second housing shell may be effectively supported in a desired position, e.g., in a position centered inside the first housing shell, thereby making it possible to dampen the transmission of vibrations in a particularly effective manner.

The hand placement region advantageously includes gripping means, which are made of a soft component, and which are connected directly with the damping means. When a hand is placed on the hand placement region, increased user comfort may therefore be attained.

In addition, low manufacturing costs may be attained when the hand placement region includes gripping means that are made of a soft component and are designed as a single piece with the damping means. The gripping means may be produced simultaneously with the damping means in one manufacturing step. For example, the gripping means and the damping means may be produced simultaneously in one injection-moulding step.

In this context, a compact design of the housing shells may be attained, in particular, when the gripping means are located on the first housing shell and include at least one section that extends through the first housing shell and continues as a damping support element for supporting the second housing shell.

Furthermore, a hand-held power tool housing unit is provided that includes a first housing shell, a second housing shell that differs from the first housing shell—the second housing shell being connected with the first housing shell via damping means—and a hand placement region located on one of the housing shells, the first housing shell at least partially enclosing the second housing shell. As a result, a large region of the hand-held power tool housing unit may be used as a vibration-damped hand placement region. All of the characteristics described above for the first and second housing shells and the damping means of the hand-held power tool are usable on the hand-held power tool housing unit.

DRAWING

Further advantages result from the description of the drawing, below. Exemplary embodiments of the present invention are shown in the drawing. The drawing, the description and the claims contain numerous features in combination. One skilled in the art will also advantageously consider the features individually and combine them to form further reasonable combinations.

Figure 2:
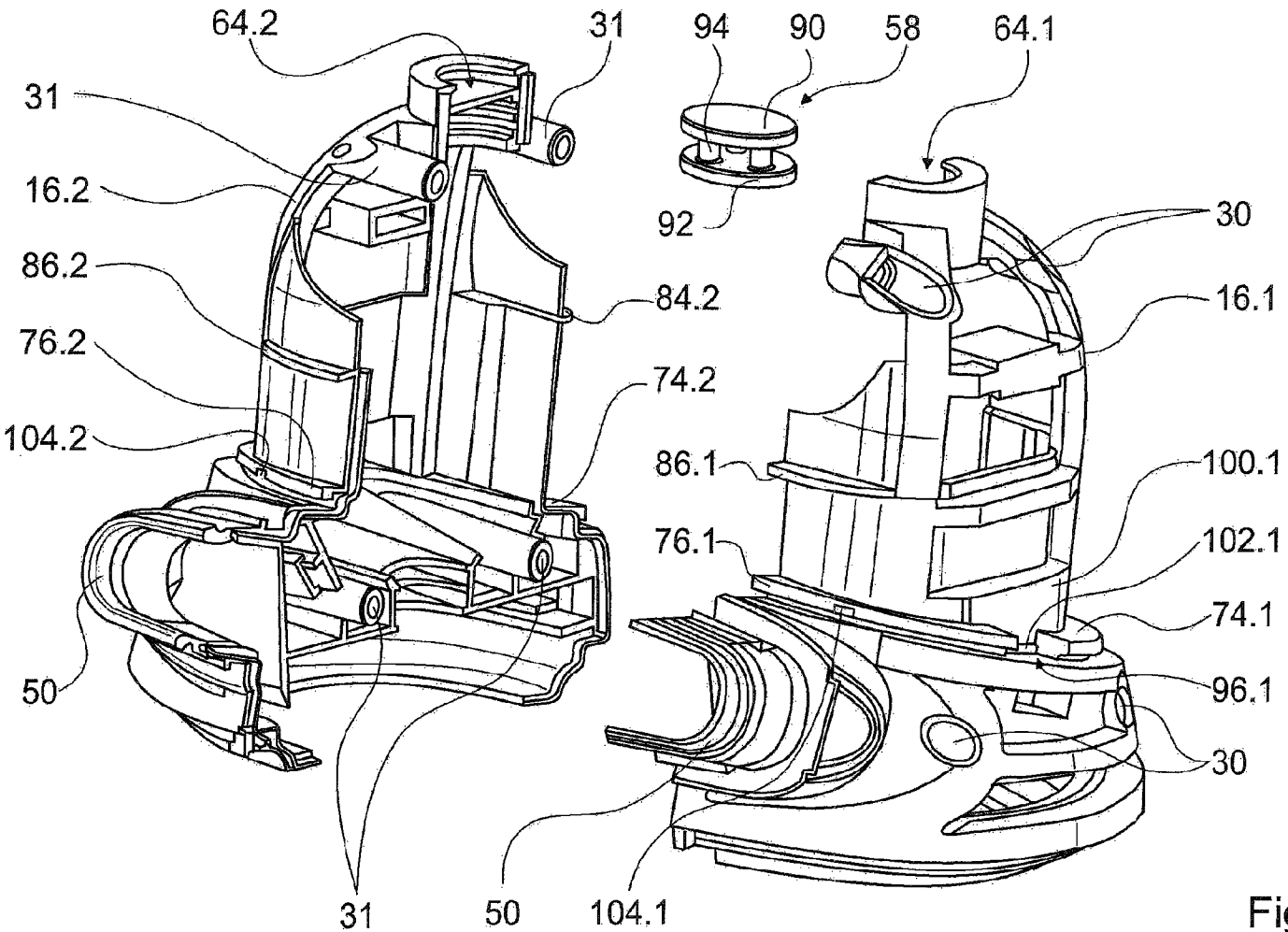
Figure 3:
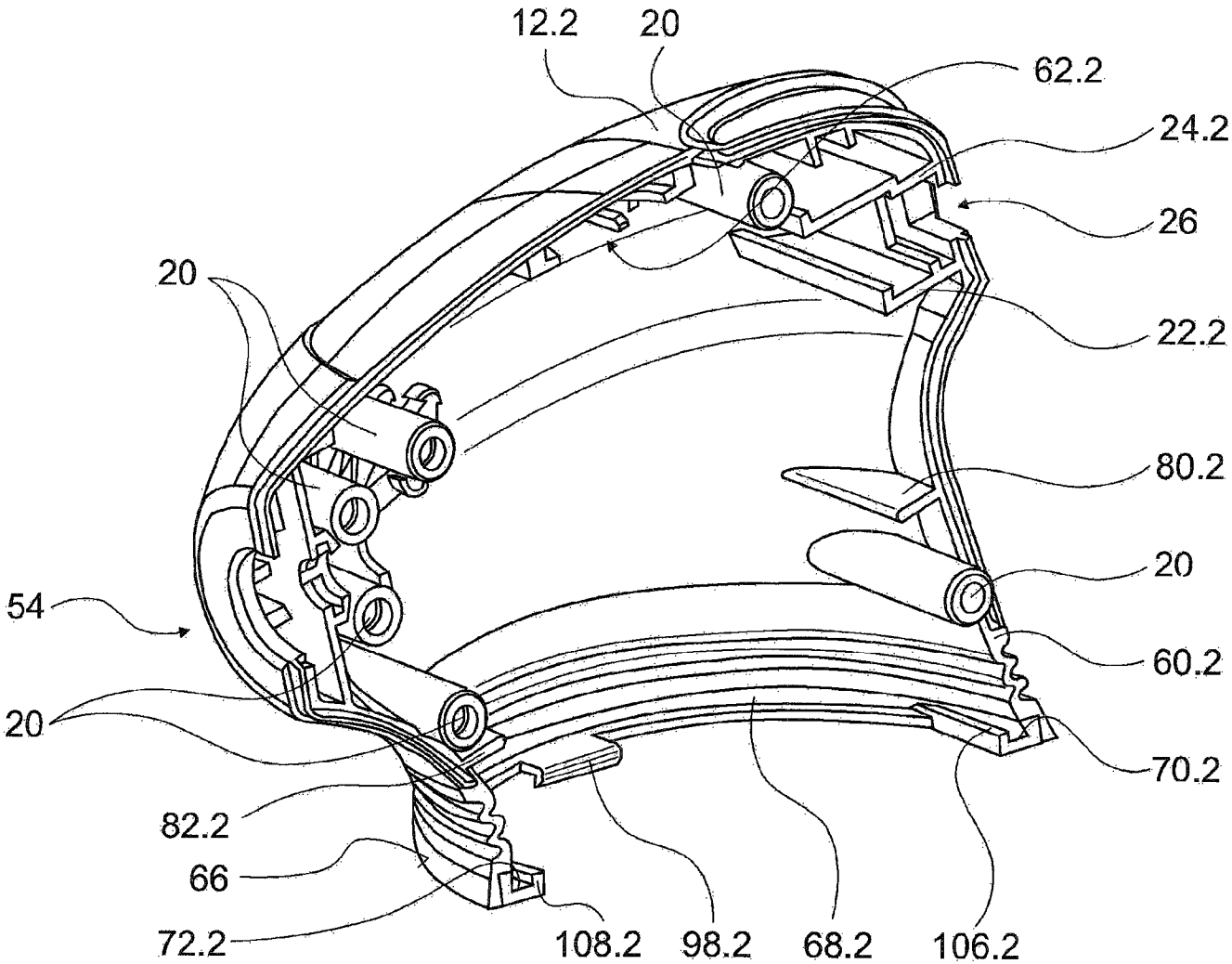
Figure 4:
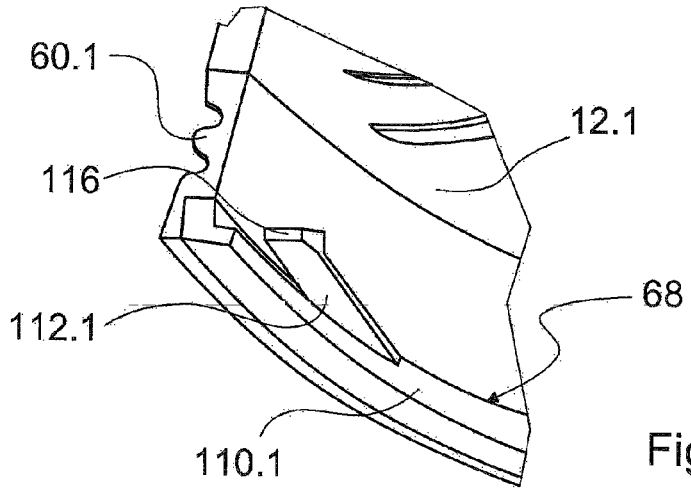
Figure 5:
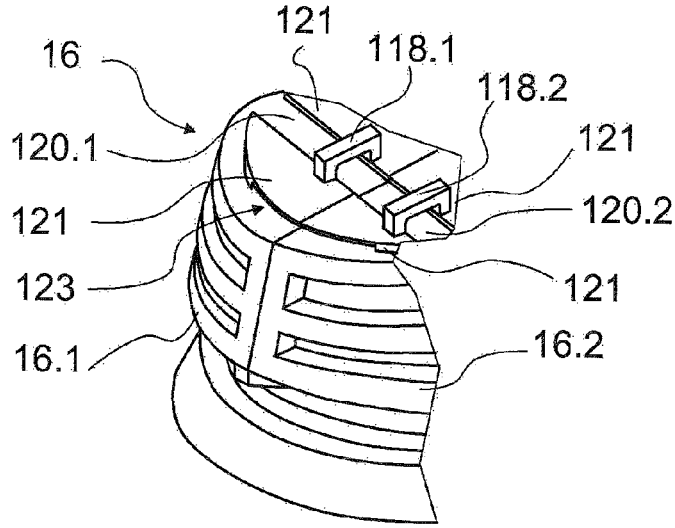
Figure 6:
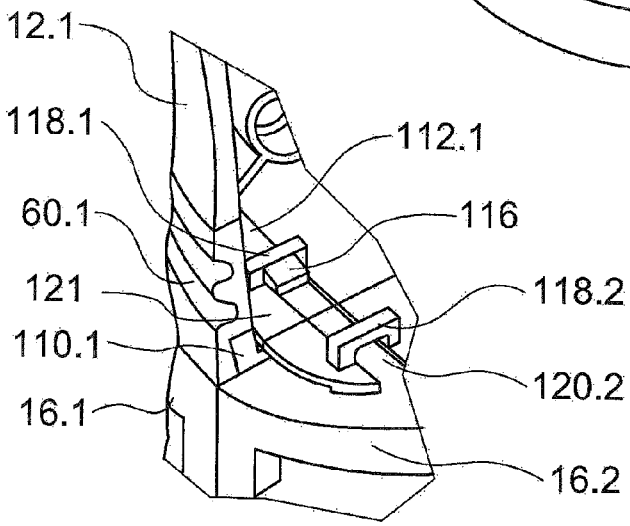
Figure 7:
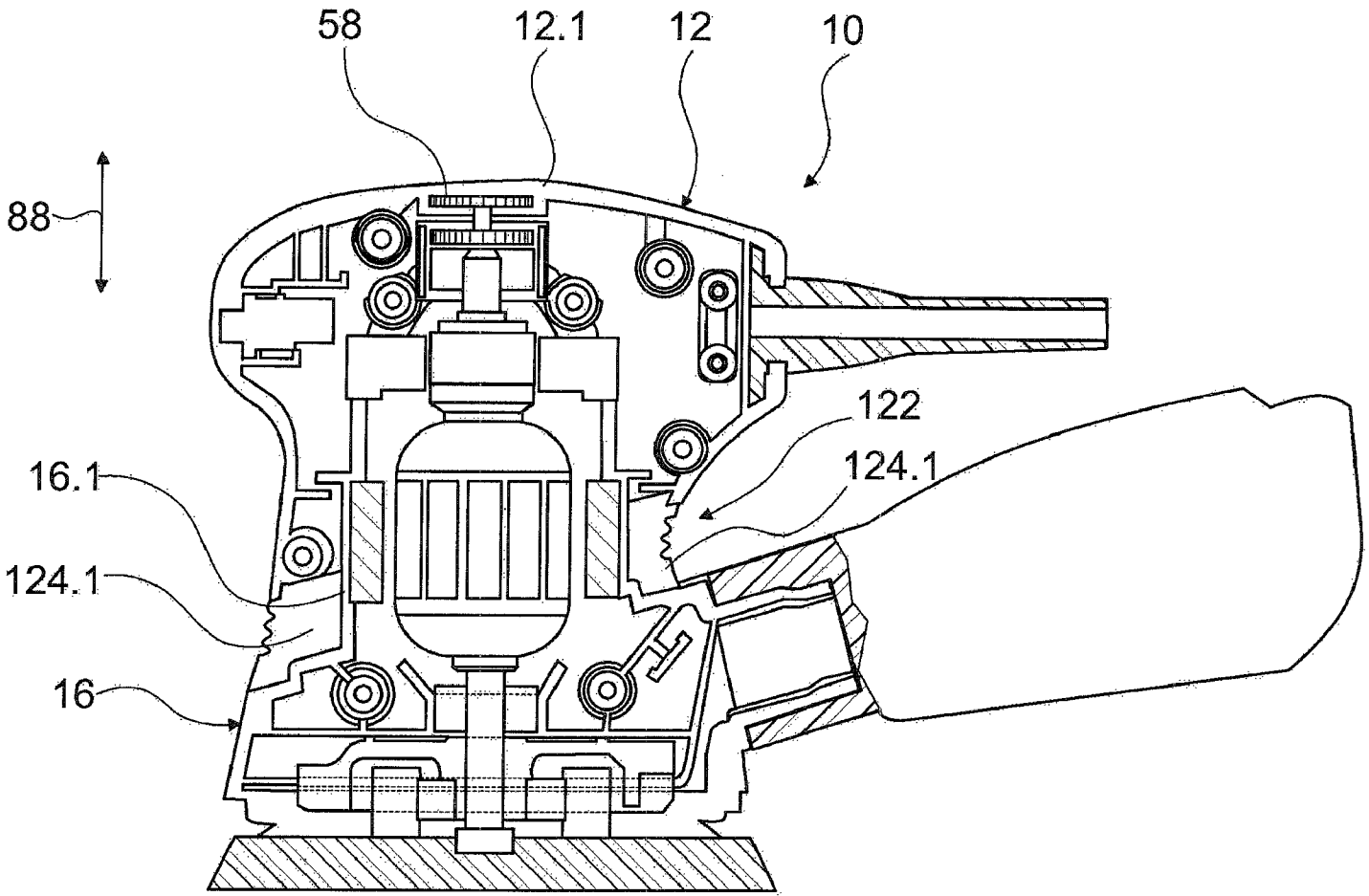
Figure 8:
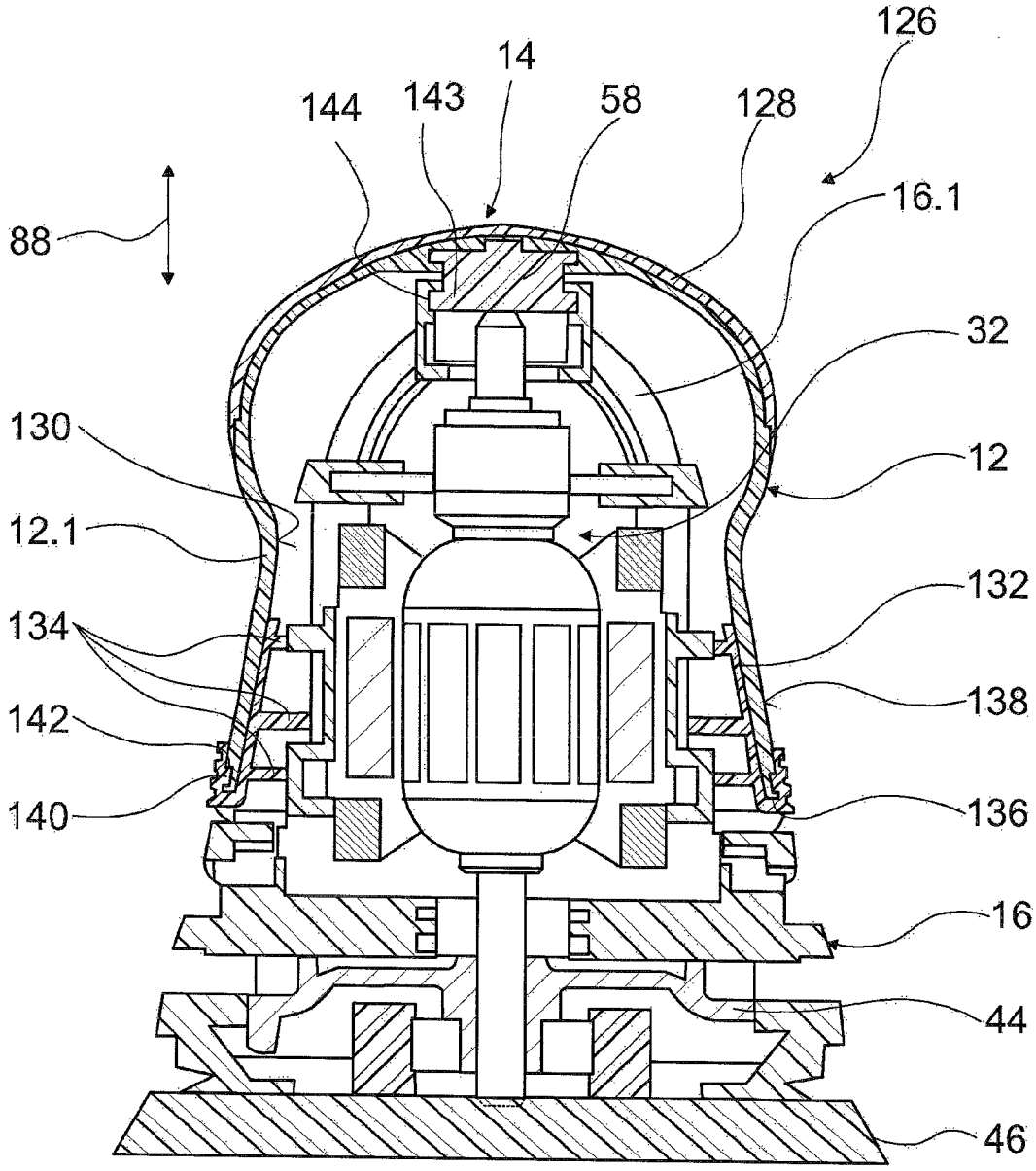
Figure 9:
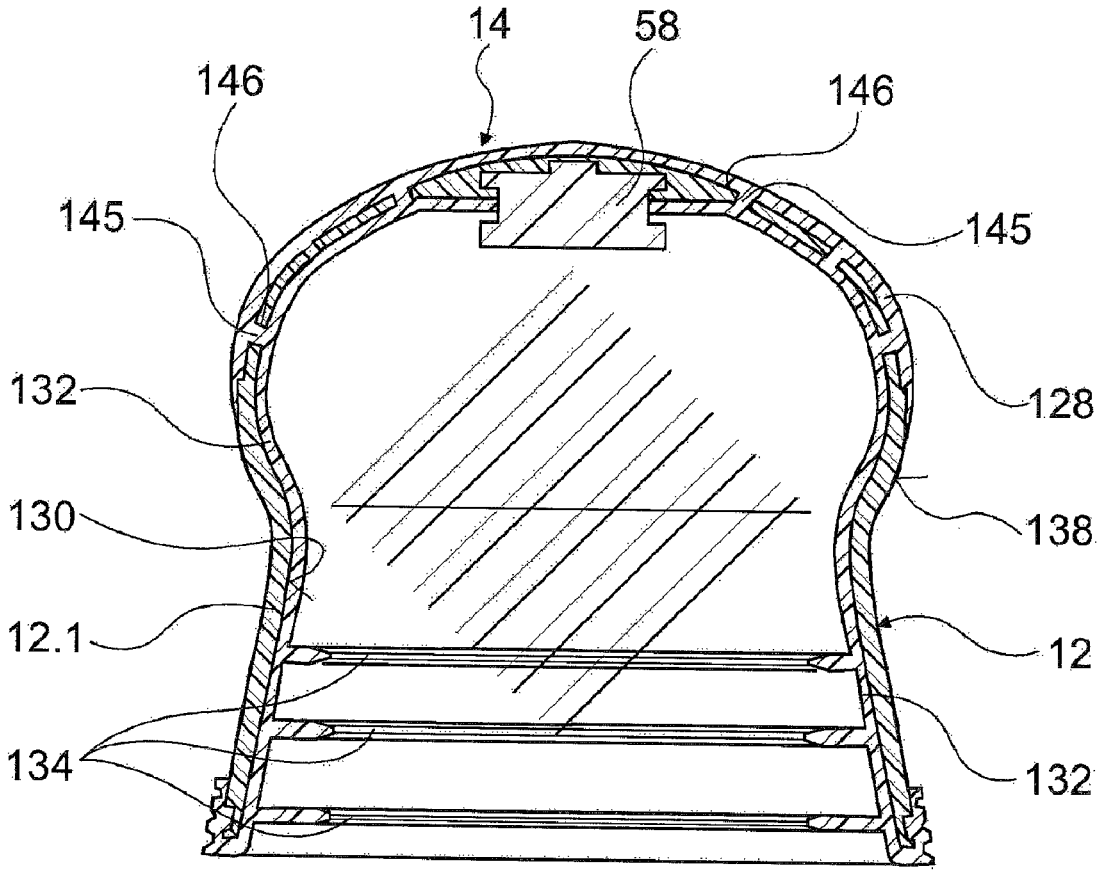
Figure 10:
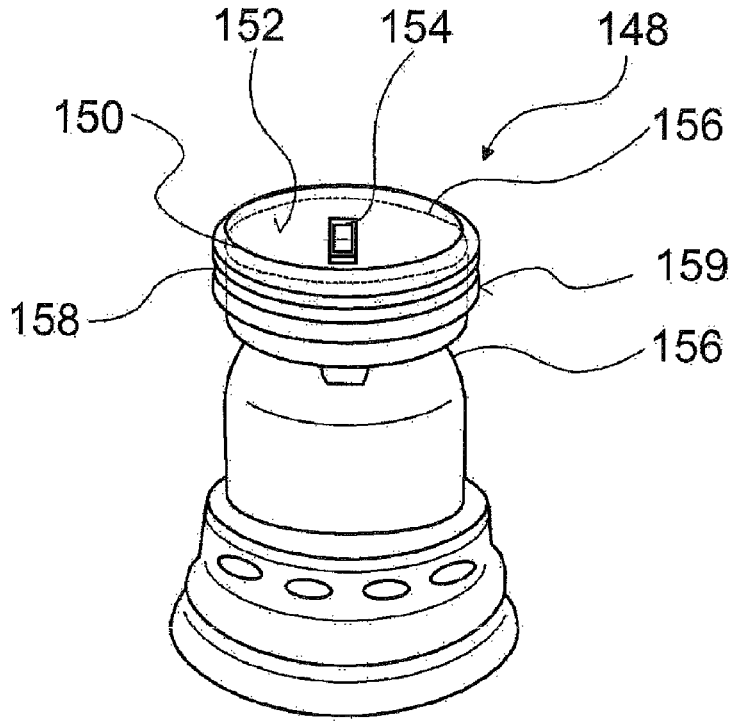
Figure 11:
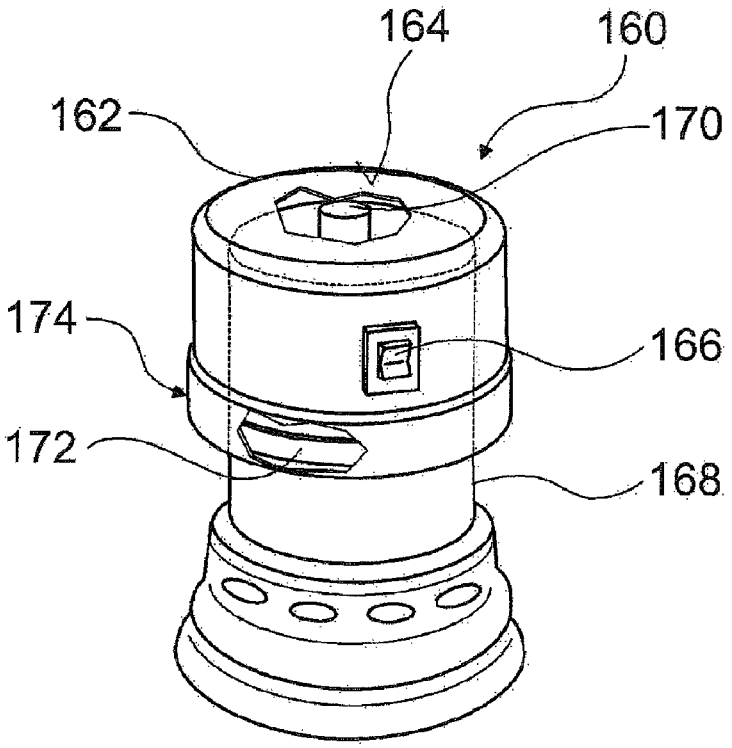

FIG. 1 shows an eccentric grinder with an outer housing and an inner housing, which are interconnected via damping means, FIG. 2 shows two shell halves of the inner housing and damping means, FIG. 3 shows one shell half of the outer housing, damping means, and an intermediate flange, FIG. 4 shows the damping means in FIG. 3 and an alternative intermediate flange, which includes a connecting segment, FIG. 5 shows the connected shell halves of the inner housing with fastening elements, FIG. 6 shows the shell halves in FIG. 5, which are installed in a shell half of the outer housing, FIG. 7 shows the eccentric grinder in FIG. 1 with alternative damping means, FIG. 8 shows a further eccentric grinder with damping support ribs, FIG. 9 shows an alternative outer housing of the eccentric grinder in FIG. 8 with a Softgrip and support ribs, and FIGS. 10 and 11 show further eccentric grinders, each with an outer housing and an inner housing.

DESCRIPTION OF THE EXEMPLARY EMBODIMENTS

FIG. 1 shows a hand-held power tool designed as an eccentric grinder 10. It includes a hand-held power tool housing unit with a first housing shell 12, which includes an outer surface designed as hand placement region 14 for placement of a hand when operating eccentric grinder 10, and a second housing shell 16. It is partially enclosed by first housing shell 12. First and second housing shells 12, 16 are each divided into two shell halves 12.1, 12.2 and 16.1, 16.2, which are screwed together in the assembled state. Eccentric grinder 10 is shown in FIG. 1 with shell halves 12.2, 16.2 removed. The description of FIG. 1 also applies to FIGS. 2 and 3, in which shell halves 12.2 and 16.2 are shown.

When shell halves 12.1, 12.2 are screwed together, screws are screwed through guide elements 18 of shell half 12.1 into fastening elements 20—designed as screw receptacles—of shell half 12.2 (see FIG. 3). Shell half 16.1 also includes guide elements 30, through which screws are screwed into fastening elements 31—designed as screw receptacles—of shell half 16.2 (see FIG. 2). Shell half 12.1 also includes segments 22.1, 24.1, which, in interaction with further segments 22.2, 24.2 of shell half 12.2 (FIG. 3), form a receiving region 26 for accommodating a switch 28.

Components of eccentric grinder 10 are installed in shell half 16.1, i.e., a motor unit 32—of which an armature shaft 34, an armature 38, a stator 40, and a commutator 42 are shown—and a dust fan 44. Holding elements for carbon brushes are located on either side of commutator 42. A sanding disc 46 is also shown, to which oscillating elements 48 are secured. Housing shell 16 also includes an extension, which is designed as a connecting element 50, on which a dust container 52 for receiving dust during operation is installed. First housing shell 12 also includes an opening 54, through which an electrical cable 56 is guided.

Housing shells 12, 16 are interconnected via damping means 58, 60. Damping means 58, which are made of a Thermoplast or elastomer, are placed in a receptacle 62.1 of shell half 12.1 and in a receptacle 64.1 of shell half 16.1. In the installed state, damping means 58 are also placed in receptacles 62.2 and 64.2 of shell halves 12.2 and 16.2 (see FIGS. 2 and 3). In the installed state, housing shells 12, 16 are therefore interconnected in a form-fit manner via damping means 58. Damping means 60, which are designed in the form of a bellows, are designed as a housing section and include a housing outer surface 66 (see FIG. 3). They include two damping parts 60.1, 60.2 (FIG. 3), which are made of a thermoplastic elastomer (TPE). In a manufacturing process, damping parts 60.1 and 60.2 are integrally extruded with shell halves 12.1 and 12.2 of first housing shell 12 in a two-component injection-moulding process. In the installed state of eccentric grinder 10, damping means 60 enclose second housing shell 16. Damping means 58, 60 advantageously dampen the transmission of vibrations produced inside second housing shell 16 to first housing shell 12, thereby making it comfortable for an operator to hold eccentric grinder 10 on hand placement region 14 during operation.

Furthermore, a holding element 68 of the hand-held power tool housing unit is integrally extruded with damping means 60, holding element 68 being provided to create a form-fit connection with second housing shell 16. Holding element 68 is designed as an intermediate flange that includes two flange parts 68.1, 68.2 (see also FIG. 3). Flange parts 68.1 and 68.2 are designed in the form of a half ring, and they are integrally joined with damping parts 60.1 and 60.2 via integral extrusion. Holding element 68 is made of a hard component, e.g., the hard component of which first housing shell 12 is made. Flange parts 68.1, 68.2 each include two guide grooves 70.1, 72.1 and 70.2, 72.2 (see also FIG. 3). In the installed state, connecting elements 74.1, 76.1 of shell half 16.1 are located in guide grooves 70.1 and 72.1, while connecting elements 74.2, 76.2 of shell half 16.2 are located in guide grooves 70.2 and 72.2 (see FIGS. 2 and 3). Connecting elements 74.1, 74.2, 76.1, 76.2 each have an L-shaped profile.

The hand-held power tool housing unit is also provided with securing means 78. Securing means 78 are designed as a stop element and include segments 80.1, 80.2, 82.1, 82.2 of first housing shell 12, and segments 84.1, 84.2, 86.1, 86.2 of second housing shell 16 (see also FIGS. 2 and 3). Via securing means 78, a motion of first housing shell 12 relative to second housing shell 16 that occurs during operation may be limited in axial direction 88 and transversely to axial direction 88. When, in special cases, damping means 58, 60 fail due to overload and are therefore unable to dampen vibrations as desired, vibrations with large amplitudes may occur. Segments 80.1, 84.1—and, therefore, further pairs of segments of housing shells 12, 16—are separated from each other in axial direction 88. The distance is determined by the amplitude of vibration that occurs during maximum load. When this distance is exceeded, acoustic warning signals occur upon impact, by way of which an operator is alerted that damage may occur. Securing means 78 also may prevent first housing shell 12 from becoming separated from second housing shell 16 when these strong vibrations occur.

FIG. 2 shows separated shell halves 16.1, 16.2 of second housing shell 16 in a perspective view. The components described above will not be described again below. FIG. 2 also shows damping means 58. They includes an upper plate 90 and a lower plate 92, which are interconnected by three leg-shaped connecting elements 94. Connecting elements 74.1, 76.1 of shell half 16.1 also form a recess 96.1. Connecting elements 74.2, 76.2 of shell half 16.2 also form a recess, which is not shown in FIG. 2, and which, in the installed state, is located in fastening element 98.2—which is designed as a latch element—of flange part 68.2 (see FIG. 3). Accordingly, in the installed state, a fastening element—which is also designed as a latch element—of flange part 68.1 is located in recess 96.1 (not shown in the figures). A space 102.1 is formed in a wall 100.1 of shell half 16.1, into which this fastening element snaps into place. Accordingly, shell half 16.2 includes a space (not shown), into which fastening element 98.2 engages. Fastening element 98.2 and the corresponding fastening element assigned to shell half 12.1 are integrally moulded with flange parts 68.2 and 68.1 (see FIG. 3).

FIG. 3 shows shell half 12.2 of first housing shell 12, damping means 60 and damping part 60.2, and holding element 68 and flange part 68.2, in a perspective view. The components described above will not be described again below.

When eccentric grinder 10 is assembled, the first step is to install the inner components—motor unit 32 and dust fan 44 in particular—in shell half 16.1 of second housing shell 16. Damping means 58 and one half of lower plate 92 are placed in receptacle 64.1. Shell half 16.2 is then placed against shell half 16.1, and the other half of lower plate 92 of damping means 58 enters receptacle 64.2. To screw shell halves 16.1, 16.2 together, screws are screwed through guide elements 30 and into fastening elements 31. Second housing shell 16, as a complete assembly, is then installed in shell half 12.1 of first housing shell 12, and connecting elements 74.1, 76.1 are inserted in guide grooves 70.1 and 72.1 of holding element 68. Connecting elements 74.1, 76.1 include openings for this purpose. One of these openings, 104.1, is shown in FIG. 2. A wall 108.1 (FIG. 1) of guide groove 72.1 engages in opening 104.1. Accordingly, a wall 106.1 of guide groove 70.1 engages in a corresponding (not shown) opening of connecting element 74.1. The fastening element—designed as a latch element—of flange part 68.1, which corresponds to fastening element 98.2 of flange part 68.2, enters recess 96.1 and engages in space 102.1, thereby resulting in a form-fit connection between shell halves 12.1, 16.1. When second housing shell 16 is inserted into shell half 12.1, one half of upper plate 90 of damping means 58 also enters receptacle 62.1. As a result, second housing shell 16 is fixed in position and secured in axial direction 88. Shell half 12.2 of first housing shell 12 is then attached to shell half 12.1, and walls 106.2, 108.2 of guide grooves 70.2, 72.2 (FIG. 3) engage in openings in connecting elements 74.2 and 76.2. Of these openings, opening 104.2 of connecting element 76.2 is shown in FIG. 2. In addition, fastening element 98.2 engages in the space of shell half 16.2, which corresponds to space 102.1 in shell half 16.1. In addition, the second half of upper plate 90 of damping means 58 is accommodated in receptacle 62.2. Shell halves 12.1, 12.2 are then screwed together by screwing fastening elements—designed as screws—through guide elements 18 and into fastening elements 20—designed as screw receptacles—of shell half 12.2.

An alternative method of fastening housing shells 12, 16 together will be described with reference to FIGS. 4, 5 and 6. Damping part 60.1, which is integrally extruded with shell half 12.1, is shown in FIG. 4. An alternative flange part 110.1 of holding element 68 is integrally extruded with damping part 60.1. A fastening element 112.1—which is designed as a segment and includes a hook 116—is integrally extruded with flange part 110.1, which is designed as a half ring. A further, identically designed fastening element is also integrally extruded with flange part 110.1, this fastening element being located opposite to fastening element 112.1 (not shown in FIG. 4). In this exemplary embodiment as well, a flange part is integrally extruded with damping part 60.2, which is fastened to shell half 12.2, the flange part being designed similar to flange part 110.1. The function of these fastening elements will be described with reference to FIGS. 5 and 6.

FIG. 5 shows second housing shell 16 in the screwed-together state. Shell halves 16.1, 16.2 each include a bridge-shaped fastening element 118.1 and 118.2, and a guide channel 120.1 and 120.2. Guide channel 120.1 is formed by two plateaus 121. Fastening element 118.1 connects plateaus 121 with each other. Accordingly, guide channel 120.1 is also formed by two plateaus 121. An open space 123 is provided underneath plateaus 121, into which one of the flange parts engages (see also FIG. 6). Shell halves 16.1, 16.2 each include a further bridge-shaped fastening element and a further guide channel, which are not shown in the figure, and which are located on a side—shown in FIG. 5—of the side diametrically opposed to housing shell 16. The fastening of second housing shell 16 to shell half 12.1 via the interaction of fastening elements 118.1 and 112.1 will be described with reference to FIG. 6.

Second housing shell 16 is shown again in FIG. 6. Housing shell 16 is installed in shell half 12.1 of first housing shell 12. Damping part 60.1—with which flange part 110.1 is integrally extruded—is shown fastened to shell half 12.1. When second housing shell 16 is slid into shell half 12.1, fastening element 112.1 (FIG. 4) engages in guide channel 120.1 (FIG. 5) until hook 116 reaches bridge-shaped fastening element 118.1. During the sliding-in motion, flange part 110.1 also engages in space 123 (FIG. 5) underneath plateau 121. As the sliding-in motion continues, hook 116 is pressed underneath fastening element 118.1 until hook 116 snaps out of it, thereby establishing a snap-in connection. An identical snap-in connection is created using the second fastening element of flange part 110.1. When shell half 12.2 is placed against shell half 12.1, snap-in connections with shell half 16.2 are established in the manner described above, in particular with the aid of fastening element 118.2.

Eccentric grinder 10 in FIG. 1 is shown in FIG. 7, with alternative damping means 122. Damping means 122, which are made of an elastic plastic, include two damping parts, which are designed as molded parts and are assigned to one of the shell halves 12.1, 12.2. A damping part 124.1 that bears against shell half 12.1 and second housing shell 16 is shown in the figure. The damping parts are designed as half rings. Once eccentric grinder 10 is assembled, damping means 122 enclose second housing shell 16. During assembly, and as described above, second housing shell 16—with its inner elements installed, is installed as a complete assembly in shell half 12.1. Damping part 124.1 is then placed between second housing shell 16 and shell half 12.1. Damping part 124.1 is compressed during insertion, so that, in the installed state, it bears against shell half 12.1 and second housing shell 16 with slight preload. As a result, second housing shell 16 is supported in a position of damping part 124.1 that is centered relative to shell half 12.1. After shell half 12.2 is screwed together with shell half 12.1, the other damping part of damping means 122 is placed between shell half 12.2 and second housing shell 16.

A further hand-held power tool designed as an eccentric grinder 126 is shown in a side view in FIG. 8. This description is limited to the differences from eccentric grinder 10 shown in FIG. 1. Elements of eccentric grinder 126 that are identical to corresponding elements of eccentric grinder 10 or that have the same mode of operation are not provided with new reference numerals.

In this exemplary embodiment, damping means 58, which serve to support shell halves 16.1, 16.2 in axial direction 88 as described above, are injection moulded into shell half 12.1 of first housing shell 12 using a two-component injection-moulding process. Hand placement region 14 also includes gripping means 128—also referred to as "Softgrip"—which are made of a soft component, which is integrally extruded with first housing shell 12 in a two-component injection-moulding process. Furthermore, damping means 132 made of an elastic plastic are integrally extruded with an inner surface 130 of shell half 12.1. Damping means 132 include supporting elements 134 designed as support ribs installed on inner surface 130, and they continue along lower edge 136 of first housing shell 12 and further along an outer surface 138. To anchor damping means 132 on outer surface 138, a holding element 140 is integrally formed with damping means 132. Holding element 140 engages in a recess 142 in shell half 12.1.

When eccentric grinder 126 is assembled, shell halves 16.1, 16.2—which are screwed together—of second housing shell 16—in which motor unit 32 and dust fan 44, in particular, are installed—are placed in shell half 12.1 of first housing shell 12 as a complete assembly. A section 143 of damping means 58 is guided into a groove 144 of second housing shell 16. Second housing shell 16 is also placed on support elements 134—which are designed as support ribs—of damping means 132 inside shell half 12.1, and housing shell 16 is centered relative to shell half 12.1. Support elements 134 are compressed slightly and, after assembly, bear against second housing shell 16 in a preloaded state.

FIG. 9 shows a further embodiment of first housing shell 12 of eccentric grinder 126 in FIG. 8. In this exemplary embodiment, gripping means 128 are designed as a single piece with damping means 132. Sections 145 are integrally formed with gripping means 128. Sections 145 extend through first housing shell 12 via recesses 146 in housing shell 12 and continue as damping means 132 with support elements 134 designed as support ribs. In an initial manufacture step, shell half 12.1 is injection-moulded using a hard component. In a subsequent step, in one injection step of a two-component injection-moulding process, gripping means 128 are integrally extruded with outer surface 138 using a soft component and, simultaneously, damping means 132 are integrally extruded with inner surface 130 of shell half 12.1 using a soft component. It is feasible, of course, to manufacture gripping means 128 and damping means 132 using various injection-moulding processes, and to use different materials for gripping means 128 and damping means 132. These materials may be paired specifically to obtain optimal grippability of gripping means 128 and to obtain particular vibration properties of damping means 132.

A further hand-held power tool designed as an eccentric grinder 148 is shown in FIG. 10. It includes a hand-held power tool housing unit with a first housing shell 150 and a second housing shell 156. First housing shell 150 partially encloses second housing shell 156. First housing shell 150 includes a hand placement region 152 and a switch 154. Housing shells 150, 156 are interconnected by damping means 158, which are made of a soft component and are designed as an annular bellows. As a result, transmission of vibrations that occur inside second housing shell 156 during operation to first housing shell 150—and its hand placement region 152 in particular—is damped. Damping means 158 are designed as a housing section and include a housing outer surface 159.

FIG. 11 shows a further hand-held power tool, which is designed as an eccentric grinder 160. It includes a hand-held power tool housing unit with a first housing shell 162 and a second housing shell 168, which is partially enclosed by first housing shell 162. First housing shell 162 includes a hand placement region 164 and a switch 166. Housing shells 162, 168 are interconnected via damping means 170, 172. Damping means 170 are made of a damping foam, e.g., polyurethane, and they are fixedly connected with second housing shell 168. In the installed state, damping means 170 bear against first housing shell 162, thereby decoupling it in terms of vibrations from second housing shell 168, in hand placement region 164. Damping means 172 are made of a damping foam, and they are fixedly connected with second housing shell 168. In the installed state, damping means 172 bear against first housing shell 162, thereby damping a transmission of vibrations that occur inside second housing shell 168 during operation to first housing shell 162 in a lateral region 174.

REFERENCE NUMERALS

| | |
|---|---|
| 10 | Eccentric grinder |
| 12 | Housing shell element |
| 12.1, 12.2 | Shell half |
| 14 | Hand placement region |
| 16 | Housing shell |
| 16.1, 16.2 | Shell half |
| 18 | Guide element |
| 20 | Fastening element |
| 22.1, 22.2, 24.1, 24.2 | Segment |
| 26 | Receiving region |
| 28 | Switch |
| 30 | Guide element |
| 31 | Fastening element |
| 32 | Motor unit |
| 34 | Armature shaft |
| 38 | Armature |
| 40 | Stator |
| 42 | Commutator |
| 44 | Dust fan |
| 46 | Sanding disc |
| 48 | Oscillating leg |
| 50 | Connecting element |
| 52 | Dust container |
| 54 | Opening |
| 56 | Cable |
| 58, 60 | Damping means |
| 60.1, 60.2 | Damping part |
| 62.1, 62.2, 64.1, 64.2 | Receptacle |
| 66 | Housing outer surface |
| 68 | Retaining element |
| 68.1, 68.2 | Flange part |
| 70.1, 70.2, 72.1, 72.2 | Guide groove |
| 74.1, 74.2, 76.1, 76.2 | Connecting element |
| 78 | Securing means |
| 80.1, 80.2, 82.1, 82.2, 84.1, 84.2, 86.1, 86.2 | Segment |
| 88 | Axial direction |
| 90, 92 | Plate |
| 94 | Connecting element |
| 96.1 | Recess |
| 98.2 | Fastening element |
| 100.1 | Wall |
| 102.1 | Space |
| 104.1, 104.2 | Opening |
| 106.1, 106.2, 108.1, 108.2 | Wall |
| 110.1 | Flange part |
| 112.1 | Fastening element |
| 116 | Hook |
| 118.1, 118.2 | Fastening element |
| 120.1, 120.2 | Guide channel |
| 121 | Plateau |
| 122 | Damping means |
| 123 | Space |
| 124.1 | Damping part |
| 126 | Eccentric grinder |
| 128 | Gripping means |
| 130 | Inner surface |
| 132 | Damping means |
| 134 | Support element |
| 136 | Edge |
| 138 | Outer surface |
| 140 | Holding element |
| 142 | Recess |
| 143 | Section |

-continued

| | |
|---|---|
| 144 | Groove |
| 145 | Section |
| 146 | Recess |
| 148 | Eccentric grinder |
| 150 | Housing shell |
| 152 | Hand placement region |
| 154 | Switch |
| 156 | Housing shell |
| 158 | Damping means |
| 159 | Housing outer surface |
| 160 | Eccentric grinder |
| 162 | Housing shell |
| 164 | Hand placement region |
| 166 | Switch |
| 168 | Housing shell |
| 170, 172 | Damping means |
| 174 | Region |

What is claimed is:

1. A hand-held power grinding tool with a first housing shell, a second housing shell which differs from the first housing shell and which is connected via at least one damping means with the first housing shell, and a hand placement region which is located on one of the first housing shell and the second housing shell; wherein the first housing shell encloses the second housing shell, at least partially, wherein the first housing shell comprises at least two shell halves which are screwed together in an installed state, wherein the at least one damping means comprises a holding element configured to connect with the first housing shell in a form-fit connection, wherein the first housing shell and the second housing shell comprise at least one securing means, wherein the at least one securing means comprises segments of the first housing shell and the second housing shell which are formed integral with the first housing shell and the second housing shell, wherein the securing means is provided to limit a relative motion of the first housing shell and the second housing shell during operation, wherein the at least one damping means is formed by integral extrusion together with the second housing shell in a two-component injection molding process, wherein the at least one damping means is configured to substantially enclose the second housing shell when in an installed state.

2. The hand-held power tool as recited in claim 1, wherein the first housing shell is connected with the second housing shell in a form-fit manner via the at least one damping means.

3. The hand-held power tool as recited in claim 1, wherein the at least one damping means is configured as a housing section that includes a housing outer surface.

4. The hand-held power grinding tool as recited in claim 1, wherein the holding element includes a fastening element, which is provided for establishing a snap-in connection with at least one of the first housing shell and the second housing shell.

5. The hand-held power tool as recited in claim 1, further comprising securing means that is provided to limit a relative motion of the first housing shell and the second housing shell during operation.

6. The hand-held power tool as recited in claim 1, wherein the damping means is configured to bear against one of the first housing shell and the second housing shell with preload when in an installed state.

7. The hand-held power tool as recited in claim 1, further comprising at least one other damping means; and wherein the hand placement region includes gripping means comprising a soft component integrally formed with the at least one other damping means.

8. The hand-held power tool as recited in claim 7, wherein the gripping means is located on the first housing shell and includes at least one section that extends through the first housing shell and is configured therein as a damping support element for supporting the second housing shell.

9. The hand-held power tool as recited in claim 1, wherein the at least one damping means includes an upper plate and a lower plate which are interconnected by at least one leg-shaped connection element.

10. A hand-held power tool as recited in claim 1, wherein the holding element comprises at least one guide groove and wherein the second housing shell comprises at least one connecting element that is located in the guide groove of the holding element when in an installed state.

11. A hand-held power tool as recited in claim 1, wherein the at least one damping element includes supporting elements that are configured as support ribs and wherein said support ribs operate to center the first housing shell relative the second housing shell.

12. A hand-held power grinding tool housing unit with a first housing shell, a second housing shell which differs from the first housing shell and is connected via at least one damping means with the first housing shell, and a hand placement region, which is located on one of the first housing shell and the second housing shell; wherein the first housing shell at least partially encloses the second housing shell, wherein the first housing shell comprises at least two shell halves which are screwed together in an installed state, wherein the at least one damping means comprises a holding element configured to connect with the first housing shell in a form-fit connection, wherein the first housing shell and the second housing shell comprise at least one securing means, wherein the at least one securing means comprises segments of the first housing shell and the second housing shell which are formed integral with the first housing shell and the second housing shell, wherein the securing means is provided to limit a relative motion of the first housing shell and the second housing shell during operation, wherein the at least one damping means is formed by integral extrusion together with the second housing shell in a two-component injection molding extrusion process, wherein the at least one damping means is configured to substantially enclose the second housing shell when in an installed state.

13. A hand-held power tool housing unit as recited in claim 12, wherein the holding element comprises at least one guide groove and wherein the second housing shell comprises at least one connecting element that is located in the guide groove of the holding element when in an installed state.

14. A hand-held power tool housing unit as recited in claim 12, wherein the at least one damping element includes supporting elements that are configured as support ribs and wherein said support ribs operate to center the first housing shell relative the second housing shell.

15. A hand-held power grinding tool, comprising:

a first housing shell;

a second housing shell which differs from the first housing shell;

at least one first damping means;

at least one second damping means which differs from the first damping means; and a hand placement region which is located on one of the first housing shell and the second housing shell;

wherein the second housing shell is connected via the first damping means and the second damping means with the first housing shell, and wherein the first housing shell encloses the second housing shell at least partially, wherein the first damping means comprises a holding element configured to connect with the second housing shell in a form-fit connection, wherein the first damping means is formed by integral extrusion with the first housing shell in a two-component injection molding process, wherein the hand placement region includes at least one gripping means, comprising a soft component integrally formed with the second damping means and wherein the gripping means is located on the first housing shell and includes at least one section that extends through the first housing shell and is configured therein as a damping support element for supporting the second housing shell.

16. The hand-held power tool as recited in claim 15, wherein the first housing shell is connected with the second housing shell in a form-fit manner via the first damping means.

17. The hand-held power tool as recited in claim 16, wherein the first damping means includes an upper plate and a lower plate which are interconnected by at least one leg-shaped connection element and wherein the upper plate and the lower plate are located in the receptacle of the first and the second housing shells when in an installed state.

18. The hand-held power tool as recited in claim 15, wherein the first damping means is located in at least one receptacle of the first housing shell and in at least one receptacle of the second housing shell.

19. The hand-held power tool as recited in claim 15, wherein the second damping means encloses the second housing shell when in an installed state.

20. The hand-held power tool as recited in claim 15, wherein the second damping means is configured as a housing section that includes a housing outer surface.

21. The hand-held power tool as recited in claim 15, wherein the holding element includes at least one fastening element, which is provided for establishing a snap-in connection with at least one of the first housing shell and the second housing shell.

22. The hand-held power tool as recited in claim 15, further comprising:

at least one securing means that;

wherein the securing means is provided to limit a relative motion of the first housing shell and the second housing shell with respect to each other during an operation.

23. The hand-held power tool as recited in claim 15, wherein the second damping means is configured to bear against one of the first housing shell and the second housing shell with preload when in an installed state.

24. The hand-held power tool as recited in claim 15, wherein the second damping means is made of a thermoplastic elastomer (TPE) and integrally extruded with the first housing shell.

25. A hand-held power tool as recited in claim 15, wherein the first housing shell and the second housing shell are provided with a securing means that is configured as a stop element and includes segments of the first housing shell and the second housing shell and wherein the securing means is provided to generate acoustic warning signals via an impact of the segments of the first housing shell and the second housing shell in case of damage of the at least one damping means.

26. A hand-held power grinding tool housing unit, comprising:

a first housing shell;

a second housing shell which differs from the first housing shell;

at least one first damping means;

at least one second damping means which differs from the first damping means; and a hand placement region which is located on one of the first housing shell and the second housing shell;

wherein the second housing shell is connected via the first and the second damping means with the first housing shell, wherein the first housing shell at least partially encloses the second housing shell, wherein the first damping means comprises a holding element configured to connect with the second housing shell in a form-fit connection, wherein the first damping means is formed by integral extrusion together with the first housing shell in a two-component injection molding process, wherein the hand placement region includes at least one gripping means, comprising a soft component integrally formed with the second damping means and wherein the gripping means is located on the first housing shell and includes at least one section that extends through the first housing shell and is configured therein as a damping support element for supporting the second housing shell.

27. A hand-held power tool housing unit as recited in claim 26, wherein the first housing shell and the second housing shell are provided with a securing means that is configured as a stop element and includes segments of the first housing shell and the second housing shell and wherein the securing means is provided to generate acoustic warning signals via an impact of the segments of the first housing shell and the second housing shell in case of damage of the at least one damping means.

28. A hand-held power grinding tool with a first housing shell, a second housing shell which differs from the first housing shell and which is connected via at least one damping means with the first housing shell, and a hand placement region, which is located on one of the first housing shell and the second housing shell, wherein the first housing shell encloses the second housing shell, at least partially, wherein the at least one damping means is configured to substantially enclose the second housing shell when in an installed state, wherein the first housing shell and the second housing shell are provided with a securing means configured as a stop element and includes segments of the first housing shell, the second housing shell and wherein the securing means is configured to generate acoustic warning signals via an impact of the segments of the first housing shell and the second housing shell in case of damage of the at least one damping means, wherein the hand placement region includes at least one gripping means, comprising a soft component integrally formed with the second damping means and wherein the gripping means is located on the first housing shell and includes at least one section that extends through the first housing shell and is configured therein as a damping support element for supporting the second housing shell.

29. A hand-held power grinding tool housing unit with a first housing shell, a second housing shell which differs from the first housing shell and is connected via at least one damping means with the first housing shell, and a hand placement region which is located on one of the first housing shell and the second housing shell, wherein the first housing shell at least partially encloses the second housing shell, wherein the at least one damping means is configured to substantially enclose the second housing shell when in an installed state, wherein the first housing shell and the second housing shell are provided with a securing means formed as a stop element and includes segments of the first housing shell and the second housing shell, wherein the securing means is configured to generate acoustic warning signals via an impact of the segments of the first housing shell and the second housing shell in case of damage of the at least one damping means, wherein the hand placement region includes at least one gripping means comprising a soft component integrally formed with the second damping means and wherein the gripping means is located on the first housing shell and includes at least one section that extends through the first housing shell and is configured therein as a damping support element for supporting the second housing shell.

30. A hand-held power grinding tool, comprising:

a first housing shell;

a second housing shell that differs from the first housing shell;

at least one first damping means;

at least one second damping means which differs from the first damping means; and a hand placement region that is located on one of the first housing shell and the second housing shell;

wherein the second housing shell is connected via the first and the second damping means with the first housing shell, wherein the first housing shell encloses the second housing shell at least partially and wherein the hand placement region includes gripping means comprising a soft component integrally formed with the first damping means, said gripping means located on the first housing shell and including at least one section configured to extend through the first housing shell and act as a damping support element for supporting the second housing shell.

31. A hand-held power grinding tool housing unit, comprising:

a first housing shell;

a second housing shell that differs from the first housing shell;

at least one first damping means;

at least one second damping means which differs from the first damping means; and a hand placement region that is located on one of the first housing shell and the second housing shell;

wherein the second housing shell is connected via the first and the second damping means with the first housing shell, wherein the first housing shell at least partially encloses the second housing shell and wherein the hand placement region includes gripping means comprising a soft component integrally formed with the first damping means, said gripping means located on the first housing shell and including at least one section configured to extend through the first housing shell and act as a damping support element for supporting the second housing shell.

* * * * *